US007938732B2

(12) United States Patent
Kuhlman, Jr. et al.

(10) Patent No.: US 7,938,732 B2
(45) Date of Patent: May 10, 2011

(54) LASER GOLF ALIGNMENT DEVICE AND METHOD

(76) Inventors: John Kuhlman, Jr., Burr Ridge, IL (US); Young Jea Shin, Plainfield, IL (US)

( * ) Notice: Subject to any disclaimer, the term of this patent is extended or adjusted under 35 U.S.C. 154(b) by 0 days.

(21) Appl. No.: 12/581,247

(22) Filed: Oct. 19, 2009

(65) Prior Publication Data

US 2010/0267460 A1 Oct. 21, 2010

Related U.S. Application Data

(63) Continuation-in-part of application No. 12/380,506, filed on Feb. 27, 2009, now Pat. No. 7,727,079.

(51) Int. Cl.
*A63B 69/36* (2006.01)

(52) U.S. Cl. ..... 473/220; 473/219; 473/266

(58) Field of Classification Search ..... 473/219, 473/220, 221, 222, 266, 268
See application file for complete search history.

(56) References Cited

U.S. PATENT DOCUMENTS 5,029,868 A 7/1991 Cloud
5,042,815 A 8/1991 Sutton
5,165,691 A 11/1992 Cook
5,435,562 A 7/1995 Stock et al.
5,452,897 A 9/1995 Mick
5,467,991 A 11/1995 White, IV et al.
5,467,992 A 11/1995 Harkness
5,713,798 A 2/1998 Brodie, Jr. ..... 473/55
5,738,595 A 4/1998 Carney
5,759,110 A 6/1998 Seibel et al.
5,810,674 A 9/1998 Falossi et al.
5,818,036 A 10/1998 Daly
5,873,789 A 2/1999 Torriano ..... 473/220
6,007,436 A 12/1999 Mark
6,213,887 B1 4/2001 Carney
6,383,087 B1 5/2002 Moser
6,672,972 B1 1/2004 Stone
6,767,291 B1 7/2004 McCarthy
6,827,651 B1 12/2004 Davis ..... 473/2
7,034,249 B2 * 4/2006 Gustafsson et al. ..... 219/124.34
7,112,145 B2 9/2006 Gaddy ..... 473/220
7,118,488 B2 10/2006 Chan et al.
(Continued)

OTHER PUBLICATIONS

"The Wire" "AccuPutt™ Laser Training System" Feb. 11, 2009.

*Primary Examiner* — Nini Legesse
(74) *Attorney, Agent, or Firm* — Clifford Kraft

(57) ABSTRACT

A portable, expandable laser golf training device that can be placed on the ground to provide alignment. The present invention can supply a plurality of light beams produced by lasers or other light sources, switchable on and off, that can be projected along the ground both in the direction of play and perpendicular to it. In a folded configuration, the device can project in four directions creating a pair of axis lines running at right angles to each other. In an expanded configuration, one of the major axis lines can be separated into two parallel lines for putting alignment by sliding the halves of the device apart. The device can be used by placing it on the ground in front of the golfer (between the golfer's feet and the ball. Two lines project outward perpendicular to the direction of play, and two or four lines project into and away from the direction of play. These lines provide alignment for the golfer. Various combinations of beams on or off can be selected by a selector switch under control of the user. The device can contain a rechargeable battery.

15 Claims, 10 Drawing Sheets

U.S. PATENT DOCUMENTS

| | | | | |
|---|---|---|---|---|
| 7,134,966 | B1 | 11/2006 | Tice | |
| 7,160,198 | B2 | 1/2007 | Coates | |
| 7,207,896 | B1 | 4/2007 | Sudol | |
| 7,727,079 | B1 * | 6/2010 | Kuhlman, Jr. | 473/220 |
| 2005/0261072 | A1 | 11/2005 | Adams | |
| 2007/0142119 | A1 * | 6/2007 | Popin | 473/220 |

* cited by examiner

LASER GOLF ALIGNMENT DEVICE AND METHOD

BACKGROUND

This is a continuation-in-part of co-pending application Ser. No. 12/380,506 filed Feb. 27, 2009. application Ser. No. 12/380,506 is hereby incorporated by reference.

FIELD OF THE INVENTION

The present invention relates generally to the field of light-aided sport improvement devices and more particularly to a laser golf or other sport alignment device and method.

DESCRIPTION OF THE PRIOR ART

There are numerous devices known in the art that place a laser or other light source somewhere on or near a golf club. For example, U.S. Pat. No. 6,007,436 teaches a laser system that helps align the golfer's feet in relation to the ball. U.S. Pat. No. 5,029,868 describes a practice high intensity light source mounted on a golf club. U.S. 2005/0261072 describes a golf club alignment device with one or two laser units connected to a golf club. U.S. Pat. No. 5,435,562 teaches a golf club having a laser generating diode and laser reflecting prism. U.S. Pat. No. 5,042,815 describes a grid-like reference system for obtaining a properly aligned golf stance. U.S. Pat. No. 5,467,991 teaches a self-contained portable unit attachable to the shaft of a golf club that supplies a beam of light. U.S. Pat. No. 5,165,691 discloses a laser golf putter assembly mounted on the putter club. U.S. Pat. No. 5,738,595 describes a hand-held laser pointing device. U.S. Pat. No. 5,818,036 describes a laser aided practice putting device. U.S. Pat. No. 5,452,897 teaches a laser putter alignment system with a mirrored surface on the ball-striking surface of the putter club. U.S. Pat. No. 6,213,887 teaches an apparatus for practicing golf using a laser aiming device. U.S. Pat. No. 7,134,966 describes a golf putt training device using a light apparatus positioned behind the ball. U.S. Pat. No. 7,118,488 discloses a training putter with a laser line projecting device. U.S. Pat. No. 6,672,972, U.S. Pat. No. 5,467,992 and U.S. Pat. No. 7,207,896 teach hat-mounted laser golf devices. U.S. Pat. No. 7,160,198 teaches a golf club swing training system. U.S. Pat. No. 6,383,087 discloses a golf putting alignment system using lasers for determining the aiming tendencies of a golfer. U.S. Pat. No. 6,767,291 teaches a putting device that includes lasers mounted on a putter. U.S. Pat. No. 5,810,674 discloses a golf club with light sources. U.S. Pat. No. 5,759,110 teaches a swing training device with a light beam along the longitudinal axis of the golf club.

All of these and other prior art methods suffer from either having a light source attached to the moving golf club or not projecting a beam where the golfer needs it most. It would be advantageous to have a laser golf alignment system and method that can place right angle beams on the ground in the direction of ball travel and perpendicular to that direction. It would also be advantageous to be able to project two separated beams in the direction of ball travel for putting.

SUMMARY OF THE INVENTION

The present invention relates to a portable, expandable laser golf training device that can be placed on the ground to provide alignment. The present invention can supply a plurality of light beams produced by lasers or other light sources, switchable on and off, that can be projected along the ground both in the direction of play and perpendicular to it. In a folded configuration, the device can project in four directions creating a pair of axis lines running at right angles to each other. In an expanded configuration, one of the major axis lines can be separated into two parallel lines for putting alignment by sliding the halves of the device apart. The device can be used by placing it on the ground of the golfer (between the golfer's feet and the ball for iron or wood, and about a foot behind the ball for putting). The device can also be placed with the ball between the golfer and the device. Two lines project outward perpendicular to the direction of play, and two or four lines project into and away from the direction of play. These lines provide alignment for the golfer. Various combinations of beams on or off can be selected by a selector switch under control of the user. The device can contain a rechargeable battery.

DESCRIPTION OF THE FIGURES Attention is now called to several illustrations that depict features of the present invention:

Several drawings and illustrations have been provided to aid in understanding the present invention. The scope of the present invention is not limited to what is shown in the figures.

DETAILED DESCRIPTION OF THE INVENTION

Figure 1:
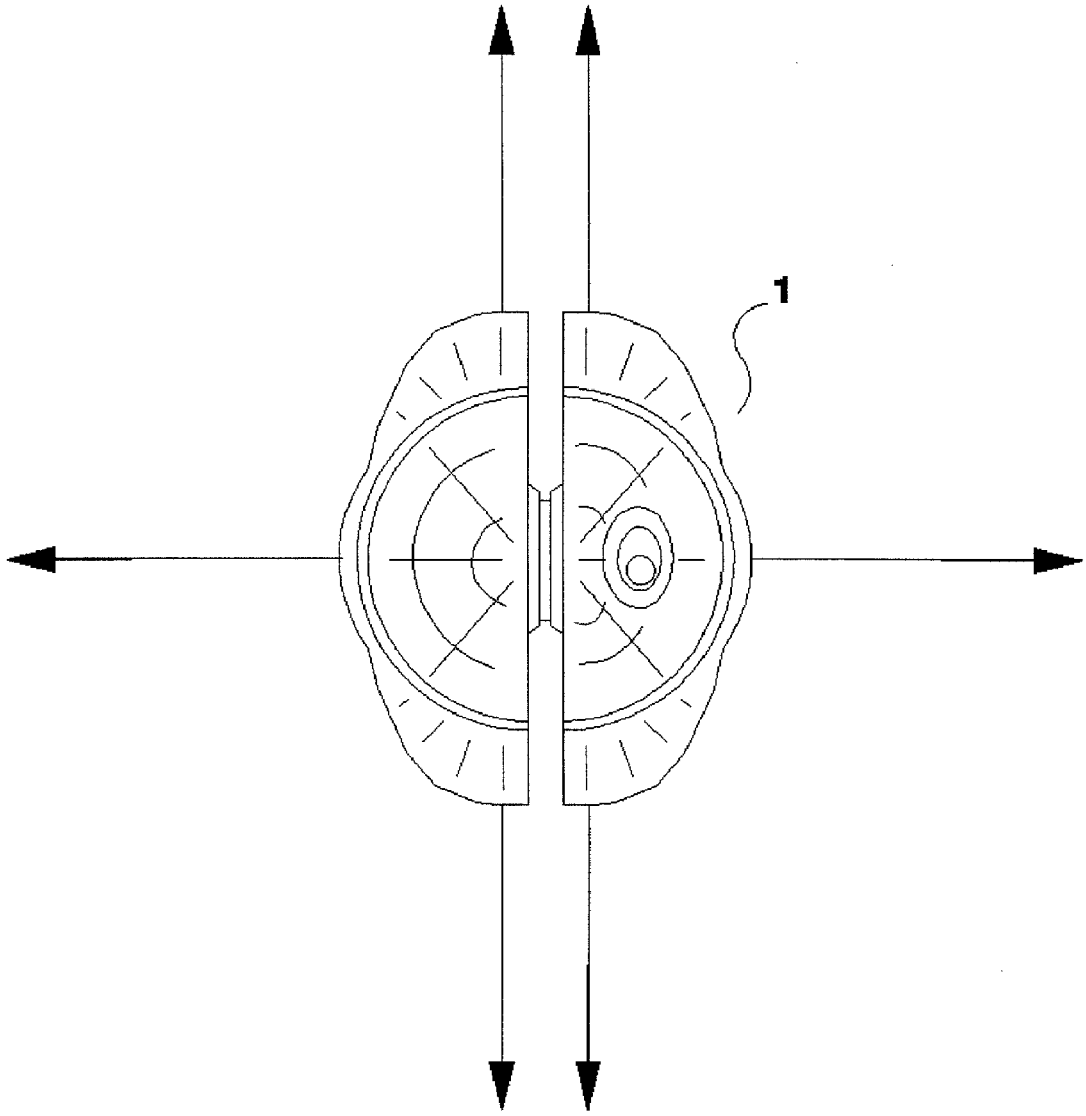
FIG. 1 shows a view of an embodiment of the present invention in the folded configuration providing four or six light beams.

The present invention relates to a golf alignment method and system that uses lasers or other light sources to project beams of light from a position on the ground between the golfer's feet and the ball. A small, battery-powered device shown in FIG. 1 can project laser beams and can be placed on the ground. In a contracted configuration, a first pair of lines is generally projected perpendicular to the direction of play (direction of ball travel). One of these first pair of lines projects outward to the ball. The second projects backward toward the golfer's feet. A second pair of lines project into and away from the direction of play (this can be four lines as shown in FIG. 1). The device can be aligned so that the lines parallel to the direction of play are correct. This causes the perpendicular lines to then also be correct. The golfer is thus in an aligned position to swing.

In an expanded configuration, a pair of parallel beams for putting can be projected along the line of play. The device can be pulled apart from the contracted to the expanded configuration to separate the lines. In any configuration, various beams can be generally switched on and off.

Figure 2:
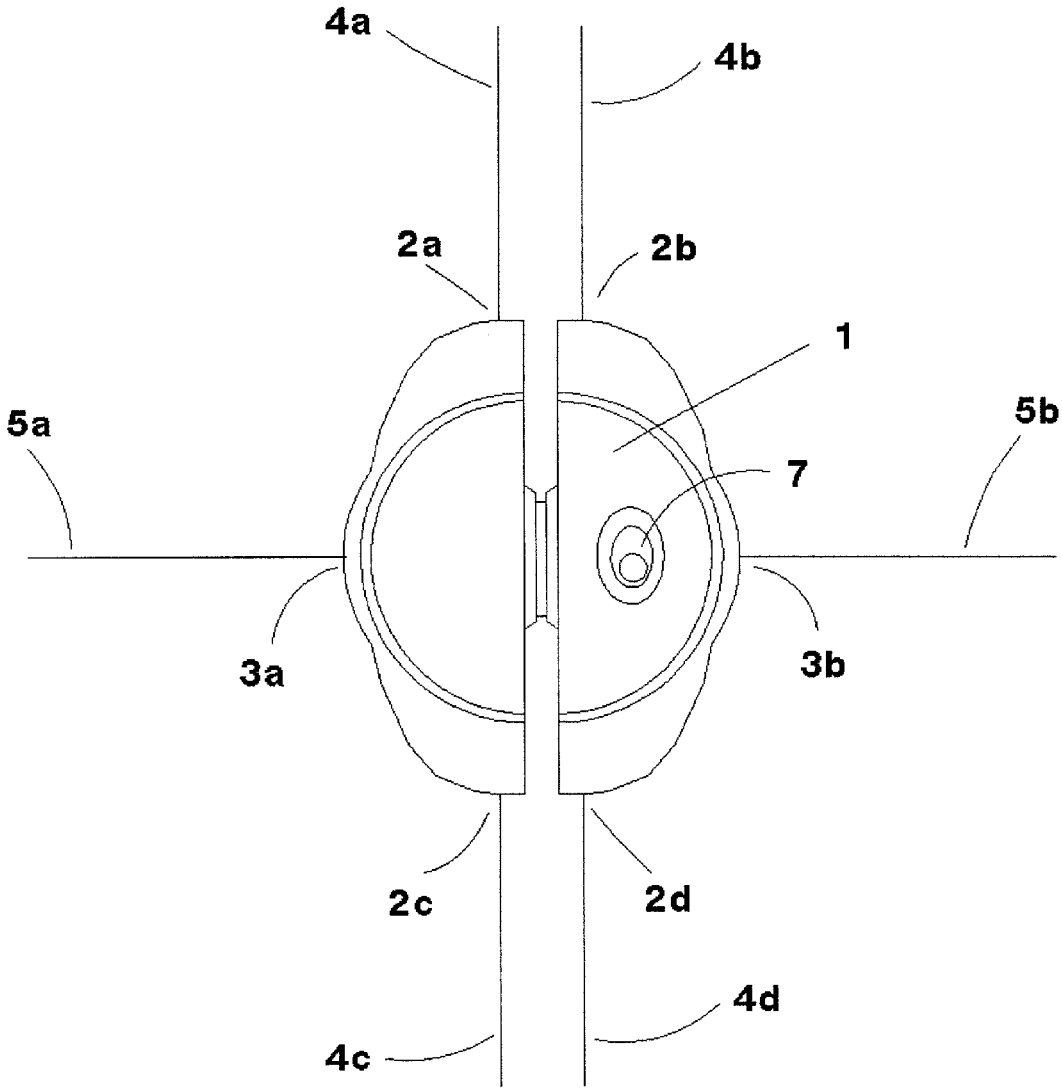
FIG. 2 is similar to FIG. 1 except that the various components of the system are labeled.

Turning to FIG. 2, a different depiction of the embodiment of FIG. 1 can be seen. The device 1 projects beams 5*a* and 5*b* perpendicular to the line of play and beams 4*a*, 4*b* and 4*c*, 4*d* parallel to the line of play. The beams are projected from lasers or laser ports 3*a*-3*b* and 2*a*-2*d*. A switch 7 on the device can switch the device on and off and control which beams are currently projecting. The configuration shown in FIGS. 1-2 is the contracted or non-expanded configuration.

Figure 3:
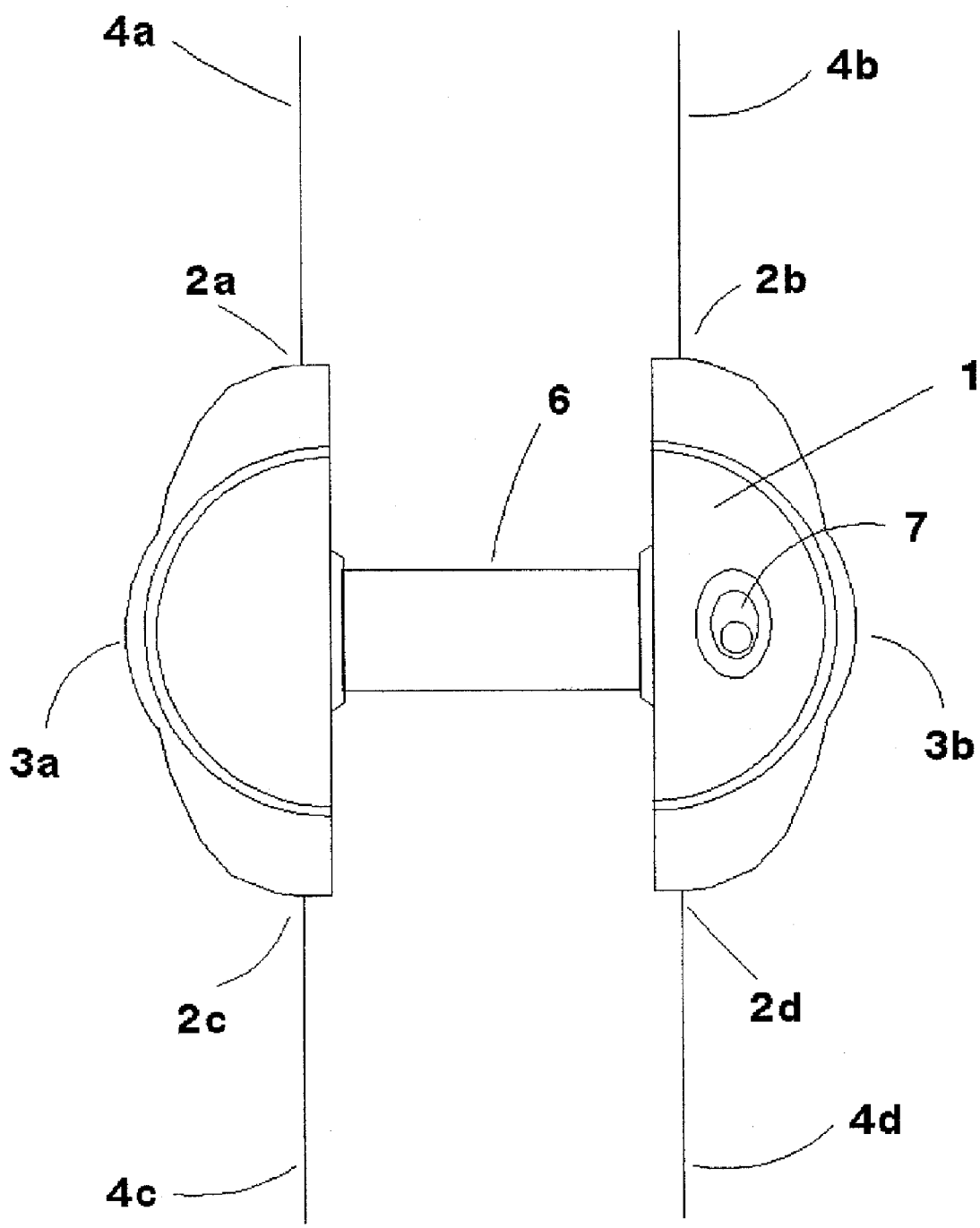
FIG. 3 shows a view of the embodiment of FIGS. 1-2 in the extended configuration providing six light beams.

FIG. 3 shows an embodiment of the device in an expanded configuration. By pulling the two halves apart the beams 4*a*, 4*c* can be separated from the beams 4*b*, 4*d*. FIG. 3 shows the other beams off. The invention can be mechanically configured to pull apart along a connecting slider bar 6. This bar 6 can connect the two halves both mechanically and electrically.

Figure 4:
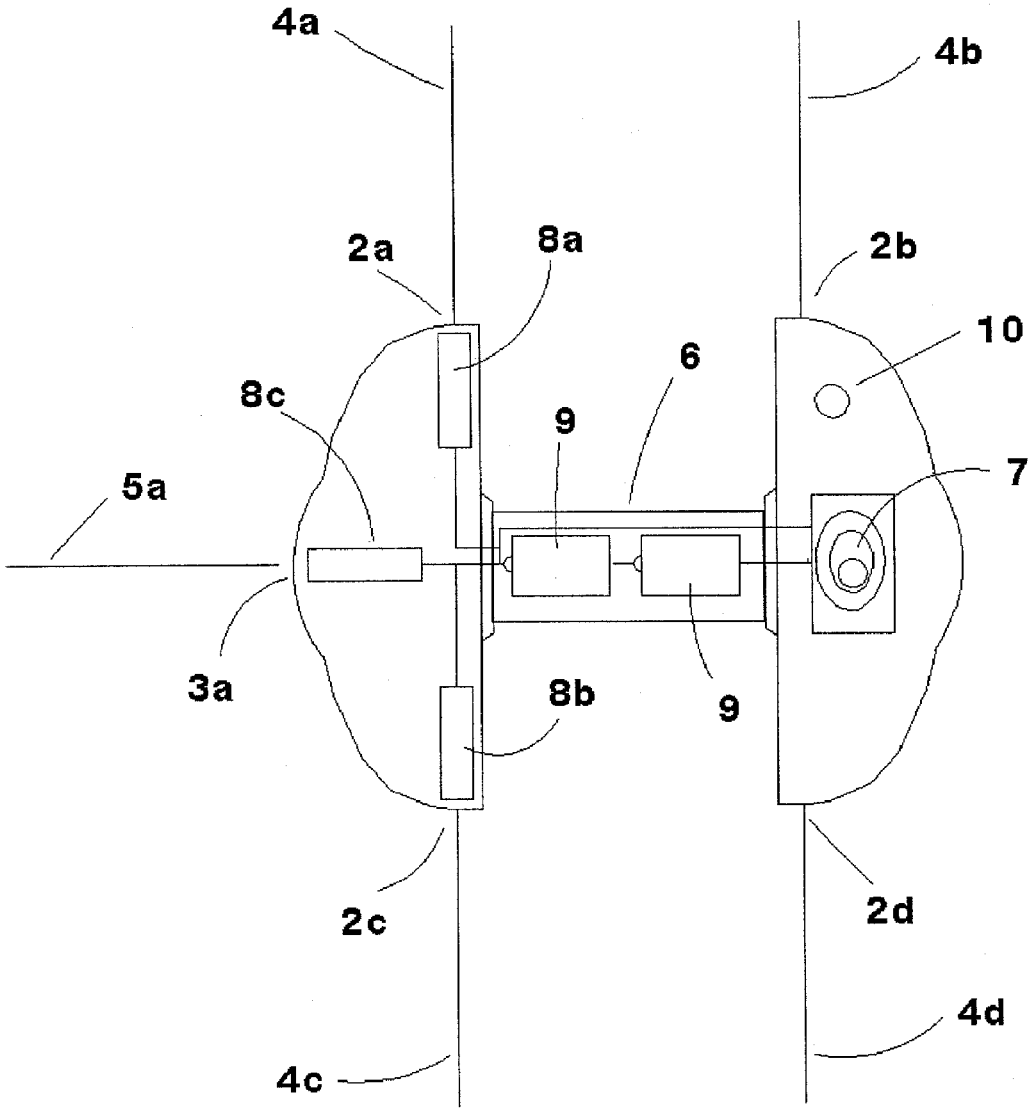
FIG. 4 shows the internal components of an embodiment of the invention.

FIG. 4 shows an embodiment of the present invention where some of the internal components can be seen. While FIG. 4 shows some connections, and the placement of some parts, various electrical connections are possible and any parts configuration is within the scope of the present invention. Three lasers 8*a*, 8*b* and 8*c* are shown in FIG. 4. These lasers are used to create beams 4*a*, 4*c* and 5*a* respectively. A pair of rechargeable batteries 9 are shown located in the center separation bar 6. The laser select and off-on switch 7 can be see along with a charging port 10 for charging the batteries 9. While two batteries 9 are shown, it will be appreciated that any number of batteries, including one, can be used to supply the correct voltage and current requirements of the device. Alternate embodiments of the invention can be made with non-rechargeable batteries.

Figure 5:
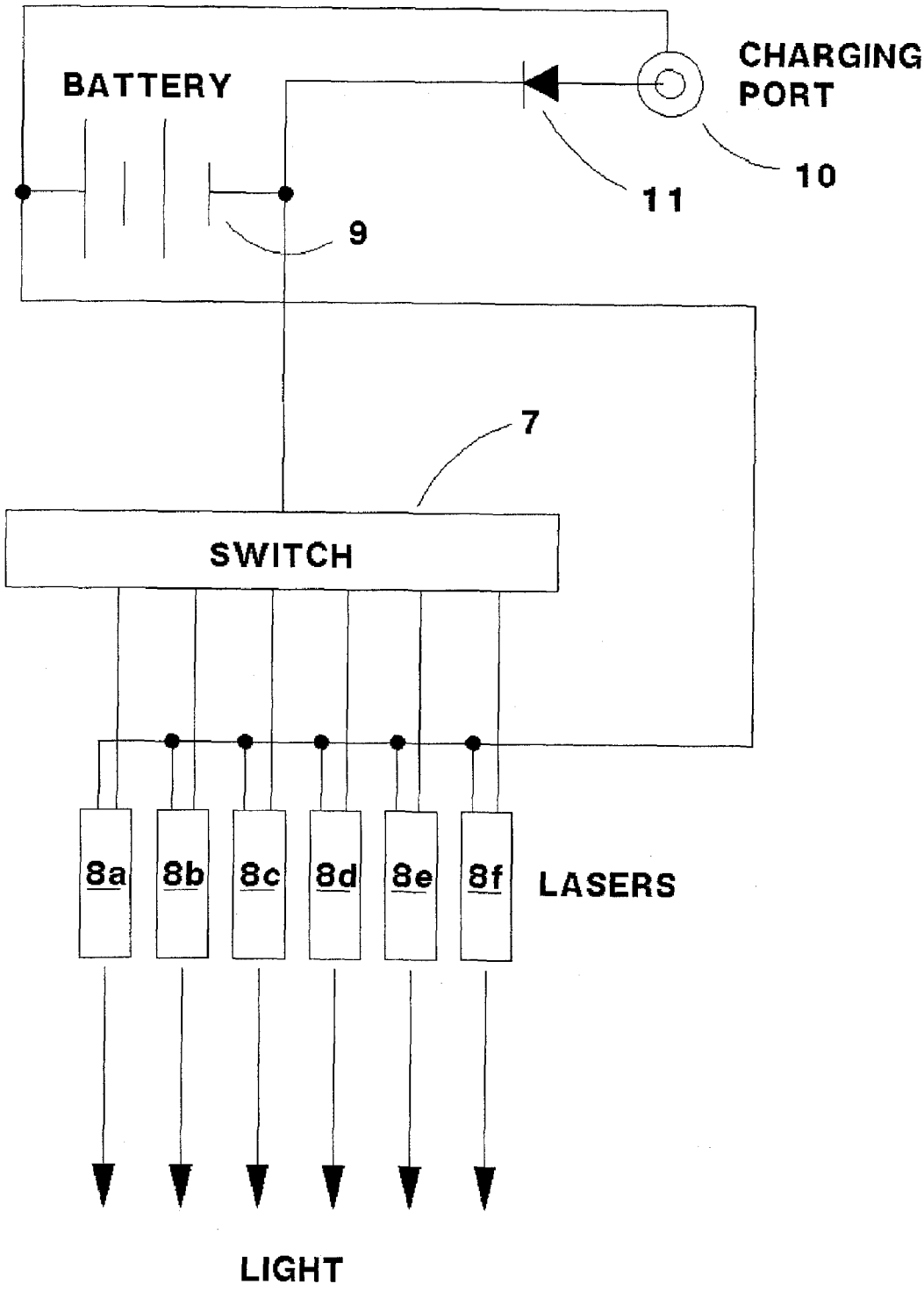
FIG. 5 shows a block diagram of the electronic portions of the invention.

FIG. 5 shows an electrical schematic diagram of an embodiment of the present invention. This schematic is representative of a preferred way of implementing the principles of the invention. It will be appreciated by one with skill in the art that numerous different circuits can be used to realize the invention. In FIG. 5, the battery 9 is connected through an optional diode 11 to an optional recharge port 10. A DC voltage from a wall transformer rectifier can be supplied to this port to recharge the battery. Alternatively, the device can include a rectifier so that AC voltage can be supplied to recharge the battery. The battery 9 is also connected to a selector switch component 7. This switch 7 can be chosen to select various desired combinations of laser beams from the various lasers 8*a*, 8*b*, 8*c*, 8*d*, 8*e* and 8*f*.

Figure 6:
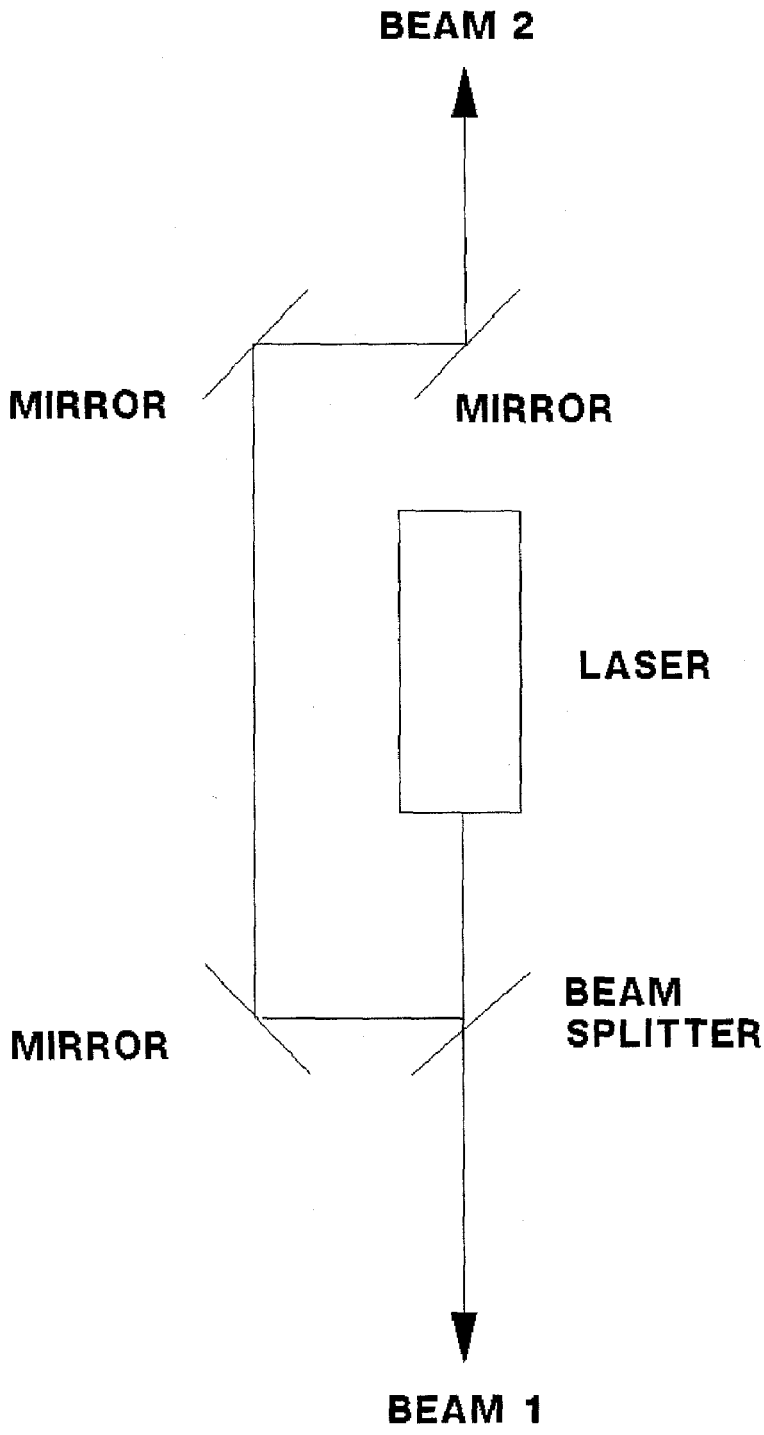
FIG. 6 shows a way of making multiple beams using a splitter and mirrors.

The embodiment of the present invention depicted in FIGS. 4-5 use several different lasers, one for each beam. It is well known in the art that a laser beam can be split. The use of a beam splitter and mirrors to cut down on the number of lasers required and the power requirements is within the scope of the present invention and is shown in FIG. 6. While this method cuts down on the number of lasers, those used must generally have more light output. In FIG. 6, the beam from a laser is split into two beams by a beam splitter. The first beam continues out of the device. The second beam is reflected by three mirrors to project out from the opposite direction from the first beam. It is within the scope of the present invention to use any number of beam splitters and mirrors to cut down on the number of lasers. Embodiments of the present invention can also be constructed with two beams, three beams, four beams and five beams of light. It is not necessary to have six beams as is shown in FIGS. 1-2.

In all cases, whether the beams are split, or whether individual lasers are used for each beam, careful alignment of the beams to be as close as possible to parallel and perpendicular is necessary. Also, all light-emitting, splitting or reflecting components should be firmly mounted to the housing to prevent shifting during use. If possible, the device should be designed to be robust in the case it is accidentally dropped of banged into something.

It should be noted that while the preceding description describes the use of lasers as light sources, any type of light source may be used such as LEDs, flashlight type beams or the like. Any type of light source of any color that can be formed into a beam is within the scope of the present invention.

Figure 7A:
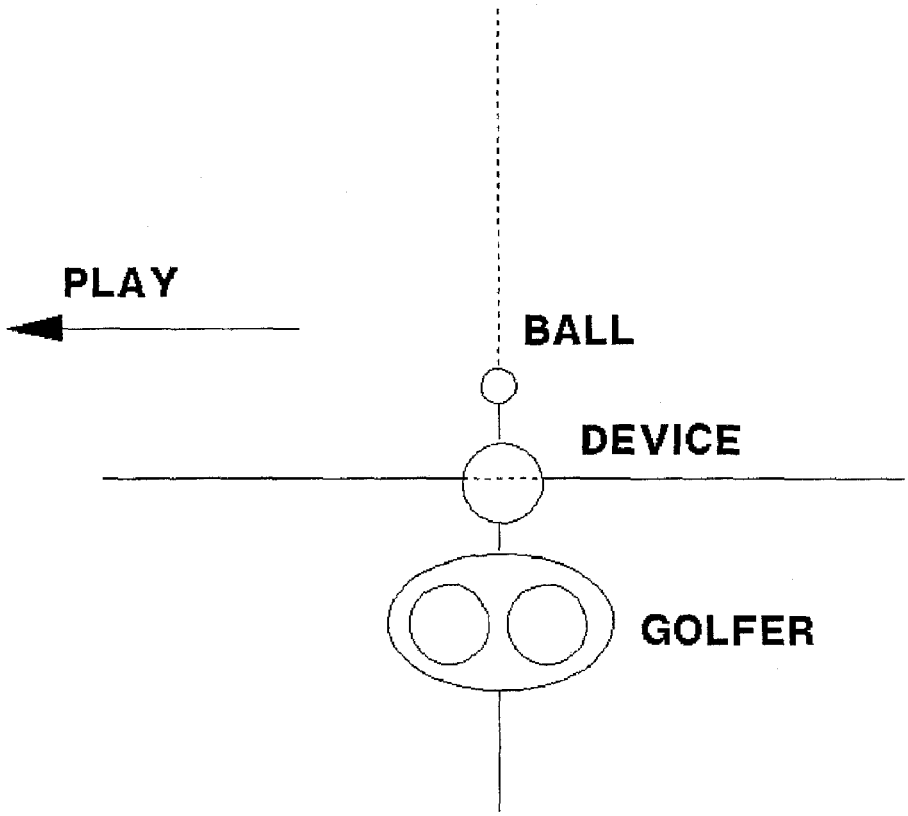
FIGS. 7A-7B show placement of the device with respect to the golfer and the ball.
Figure 7B:
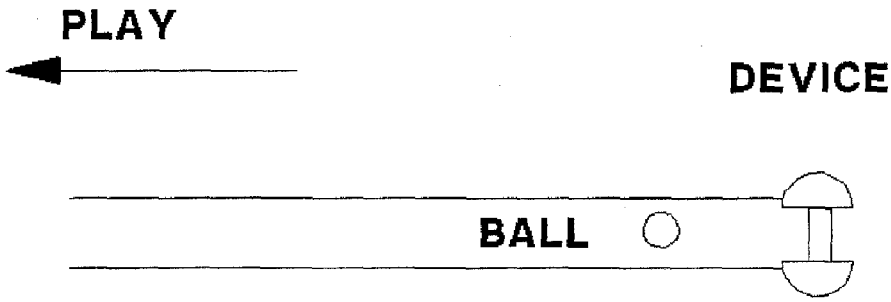

Turning to FIGS. 7A-7B, placement of the device of the present invention on the ground can be seen. FIG. 7A shows the placement is that used for wood and irons with the device positioned around half way between the golfer's shoe tips and the ball. It can also be placed with the ball between the device and the golfer. FIG. 7B shows the placement used for putting with the device around a foot behind the ball.

Figure 8:
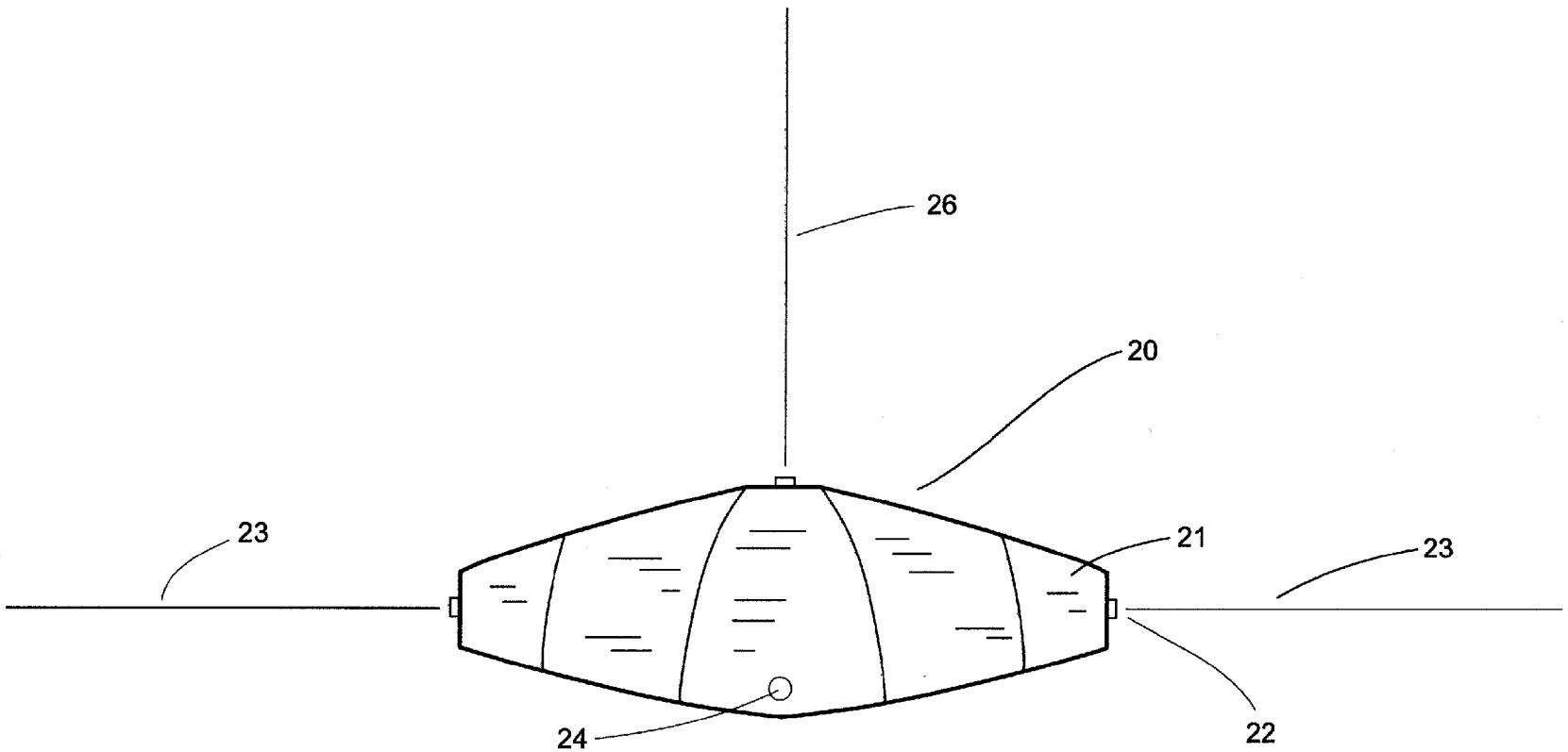
FIG. 8 shows a different embodiment of the present invention in "Swing" mode.
Figure 9:
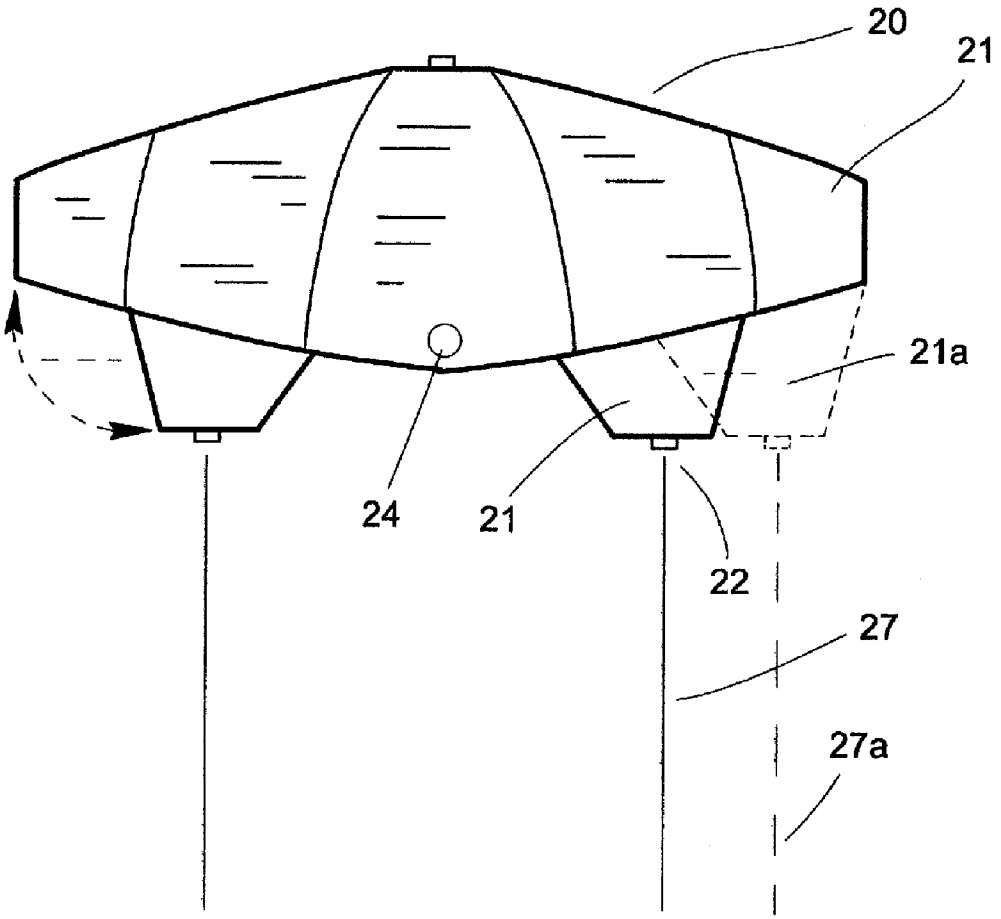
FIG. 9 shows the embodiment of FIG. 8 in a "Putt" mode.

FIGS. 8-9 show a top-down view of an embodiment of the present invention that has an elongated body 20 that can sit on the ground or a floor. This embodiment has two modes, a "swing" mode shown in FIG. 8 and a "putt" mode shown in FIG. 9. In the swing mode of FIG. 8, three laser beams are projected outwards from the device, one in the direction of play 26 and two perpendicular to the direction of play 23. The laser ports 22 are mounted on swivel end pieces 21. In this mode, this embodiment can be used to improve a golfer's swing. It can be used with other sports such as billiards, baseball, hockey and any other sport to provide perpendicular lines. In billiards, it can be used to align the ball with the pocket. In the putt mode of FIG. 9, the swivel end pieces 21 have been rotated 90 degrees to produce two generally parallel beams 27. The third beam has been automatically turned off. In this mode, the end pieces 21 can also be moved apart to a wider position 21*a*. They can slide linearly to any position in between to allow adjustment of the distance between the beams 27*a*. An optional off-on switch 24 can be placed on the device. In an alternate embodiment of the present invention, the swivel pieces 21 can be adjusted to produce any angle between the beams 27.

Optionally, the center light source can turn off automatically when the device is switched between the swing and putt modes and can turn on automatically when the device is switched between the putt and swing modes. It should be noted that the light beams can be any color including white; however, the preferred color for outdoors is green, and the preferred color for indoors is red.

Figure 10:
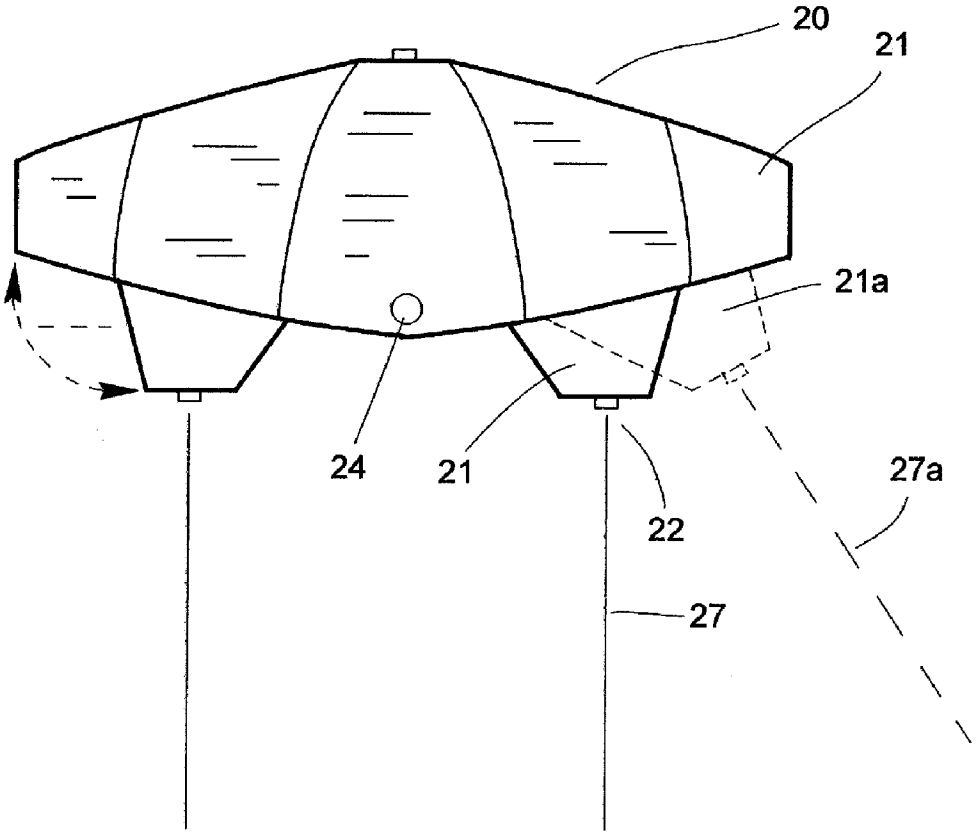
FIG. 10 shows an embodiment where the swivel platform can point to any angle.

The swivel pieces 21*a* or end-mounted platforms can optionally be separately and independently adjusted to any outward angle in an alternate embodiment shown in FIG. 10. This is useful for situations or sports that need light beams that diverge at an acute or obtuse angle. It is also optionally possible to cause the end-platforms 21*a* to separately and independently click-lock to particular angles (such as 0 degrees and 90 degrees, or any other angles) such as is shown in FIG. 10.

It should be noted that the present invention is not limited to golf or even sports. Rather, it can be used in numerous applications for alignment and making beams in a plane such as for classroom blackboards, construction, etc., and it can be used in any sport that has directions of play.

Several descriptions and illustrations have been presented to aid in understanding the present invention. One with skill in the art will realize that numerous changes and variations can be made without departing from the spirit of the invention. Each of these changes and variations is within the scope of the present invention.

We claim:

1. A sport alignment device comprising:

an elongated housing with a center region and two ends;

a first light source located in said housing's center region;

second and third light sources located in said ends on swivel platforms;

a battery contained in said housing;

at least one control switch attached to said housing;

wherein said battery is electrically connected to said control switch and to said light sources, and wherein said control switch can activate or deactivate said light sources; said device having two modes;

wherein, in a first mode, said device projects at least three light beams in a plane, a first beam in a direction of play, a second beam in a direction perpendicular to the first beam, and a third beam in a direction opposite to the direction of the second beam; and wherein, in a second mode, said second and third light sources swivel approximately 90 degrees to project two parallel beams in said plane.

2. The sport alignment device of claim 1 wherein in said second mode the second and third and third light sources can move toward or away from each other changing distance between said two parallel beams.

3. The sport alignment device of claim 1 wherein said first light source shuts off automatically when said device is switched between the first and second modes, and said first light source turns on automatically when said device is switched between the second and first modes.

4. The sport alignment device of claim 1 wherein in the second mode, said beams point in a same direction.

5. The sport alignment device of claim 1 wherein each of said beams is produced by a laser.

6. The sport alignment device of claim 5 wherein said laser is a solid-state laser.

7. The sport alignment device of claim 1 wherein said beams are green.

8. A golf alignment device comprising an elongated housing that has a center-mounted laser and two end-mounted lasers, the end-mounted lasers each being attached to rotatable and slideable end-platforms, wherein in a first mode, the device projects two beams of light outward from the ends of the elongated housing along a longitudinal axis of the elongated housing from said end-mounted lasers and a third beam of light outward from said center-mounted laser perpendicular to the two beams of light, and wherein, in a second mode, with said end-platforms rotated approximately 90 degrees, said end mounted lasers project two approximately parallel beams of light perpendicularly to said longitudinal axis, and wherein said end-platforms can be slide in the direction of said longitudinal axis toward or away from each other changing the separation between said to approximately parallel beams of light.

9. The golf alignment device of claim 8 wherein said center-mounted laser automatically turns off in said second mode.

10. The golf alignment device of claim 8 further comprising a rechargeable battery.

11. The golf alignment device of claim 8 wherein said beams of light are all green.

12. The golf alignment device of claim 8 wherein said beams of light are all red.

13. The golf alignment device of claim 8 wherein said lasers are solid-state lasers.

14. The golf alignment device of claim 8 further comprising a third mode wherein said end-platforms can be independently positioned at any angle.

15. The golf alignment device of claim 8 wherein said end-platforms lock to one or more angular positions.

* * * * *